US005513861A

United States Patent [19]

Monroy et al.

[11] Patent Number: 5,513,861

[45] Date of Patent: May 7, 1996

[54] IN-LINE ROLLER SKATE FRAME

[76] Inventors: Mario F. Monroy; Craig A. Justice, both of 9047 Montana, Livonia, Mich. 48150

[21] Appl. No.: 920,141

[22] Filed: Jul. 24, 1992

[51] Int. Cl.[6] ..... A63C 17/06

[52] U.S. Cl. ..... 280/11.22; 301/5.3

[58] Field of Search ..... 280/11.22, 11.23, 280/11.2; 301/5.3, 5.7; 411/399, 166

[56] References Cited

U.S. PATENT DOCUMENTS

| | | | |
|---|---|---|---|
| 480,610 | 8/1892 | Nielson | 280/11.22 |
| 1,715,975 | 6/1929 | Angell | 411/166 |
| 1,822,657 | 9/1931 | Horton | 411/166 |
| 2,048,916 | 7/1936 | Bentzlin | 280/11.22 |
| 2,049,259 | 7/1936 | Greenwood | 411/399 |
| 4,418,929 | 12/1983 | Gray | 280/11.23 |
| 4,909,523 | 3/1990 | Olson | 280/11.2 |
| 5,046,746 | 10/1991 | Gierveld | 280/11.22 |
| 5,068,956 | 12/1991 | Malewicz | 280/11.27 |
| 5,092,614 | 3/1992 | Malewicz | 280/11.22 |
| 5,129,663 | 7/1992 | Soo | 280/11.22 |

FOREIGN PATENT DOCUMENTS

| | | | |
|---|---|---|---|
| 295081 | 12/1988 | European Pat. Off. | 280/11.22 |

*Primary Examiner*—David M. Mitchell
*Attorney, Agent, or Firm*—George L. Boller

[57] ABSTRACT

Improved support and adjustment of the frame on the boot are obtained by providing mounting brackets that extend transversely outwardly and beyond the underlying side walls between which the roller wheels are mounted and that contain transverse mounting slots whose transverse extents are at least as great as the spacing distance between the underlying side walls. Improved parallelism of the axles is obtained by providing diametrically opposed lobes in a mounting hole in one of the side walls at each wheel mount and by providing the corresponding axle head with a complementary shape fitting to that portion of the mounting hole containing the lobes. A tool for installing and removing the wheels from the frame is also disclosed.

7 Claims, 5 Drawing Sheets

IN-LINE ROLLER SKATE FRAME

FIELD OF THE INVENTION

This invention relates to an in-line roller skate frame, particularly to the mounting of the roller wheels on the frame, to the mounting of the frame to a skating boot, and to a tool which is useful for installing and removing the roller wheels on and from the frame.

BACKGROUND OF THE INVENTION

It is known to fabricate an in-line roller skate frame from a metal extrusion by selectively machining the extrusion. The machining creates two side walls that extend lengthwise of the frame and that are spaced apart transversely of the frame. The side walls are bridged by mounting brackets that are spaced lengthwise of the frame to provide for mounting of the frame to the heel and sole regions of the skating boot. It is further known to provide a transverse slot in one of these mounting brackets so that a fastening means which is used to fasten the frame to the boot can pass through and provide a limited degree of transverse adjustment of the frame on the boot at that mounting bracket.

It is also known to mount the roller wheels between the side walls of the frame by means of axles that fit in aligned through-holes in the side walls. The axle has a D-shaped head and a shaft extending from that head. The D-shaped head fits into a complementary D-shaped counterbore in an outside surface of one sidewall with the intention of constraining the axle against turning in the through-holes when a screw is tightened into the opposite end of the shaft to secure the axle on the frame.

According to one aspect of the present invention, a differently shaped axle head and counterbore are provided. The new head and counterbore have been conceived as a result of the Applicant's discovery that the D-shaped head and counterbore tend to create slight, but nonetheless significant, distortion of the axle from an axis that is exactly perpendicular to the side walls of the frame. Since the typical in-line roller skate has from four to six roller wheels, the cumulative effect of these distortions can impair the efficiency of the skate. Such loss of efficiency detracts from the maximum speed that a given skater can attain with the skate, requiring a greater input from the skater to attain a given speed.

The ability of an in-line roller skate to attain optimum conformance to a given skater has also been found to depend upon the ability to position the frame on the boot. While the use of a transverse slot in a mounting bracket, as mentioned above, may afford some limited capability for frame/skate adjustment, the extent of that capability has been limited by the fact that the transverse spacing distance between the frame's side walls is defined by the width of the roller wheels.

According to another aspect of the invention, both mounting brackets of the frame are provided with a boot-confronting wall that extends transversely of the frame over and outwardly beyond both of the frame's side walls and through-slots extend in these mounting bracket walls transversely of the frame to span at least the spacing distance between the side walls. As a result, this aspect of the invention provides a substantially greater range for positioning the frame on the boot so that it can be better conformed to the preference of the user, and at the same time the transversely extended mounting bracket walls provide a larger area of transverse support against the boot without having to increase the spacing distance between the side walls of the frame where the roller wheels are mounted. This means that wider roller wheels are not required in order to attain the improved positioning capability of the frame on the boot and the improved transverse support of the boot on the mounting brackets.

A still further aspect of the invention relates to an improved capability for installing and removing roller wheels on and from the frame. Part of this capability is achieved because of the aforementioned new shapes that are imparted to the axle head and the counterbore in one of the frame side walls. Another part of this improved capability is achieved through the use of a special tool that facilitates the installation and removal of the roller wheels on and from the frame. A significant advantage of the improved installation and removal of the roller wheels is that such installation and removal can be performed on a wheel-by-wheel basis without the necessity of removing the frame from the boot. Specific details of the new shapes that have been imparted to the axle head and counterbore and of the tool will be described in the following Detailed Description of A Presently Preferred Embodiment of the Invention. Further features, advantages, and benefits of the invention will be disclosed in the description and drawings and may be perceived by the reader as the description proceeds.

DETAILED DESCRIPTION OF A PRESENTLY PREFERRED EMBODIMENT

Figure 1:
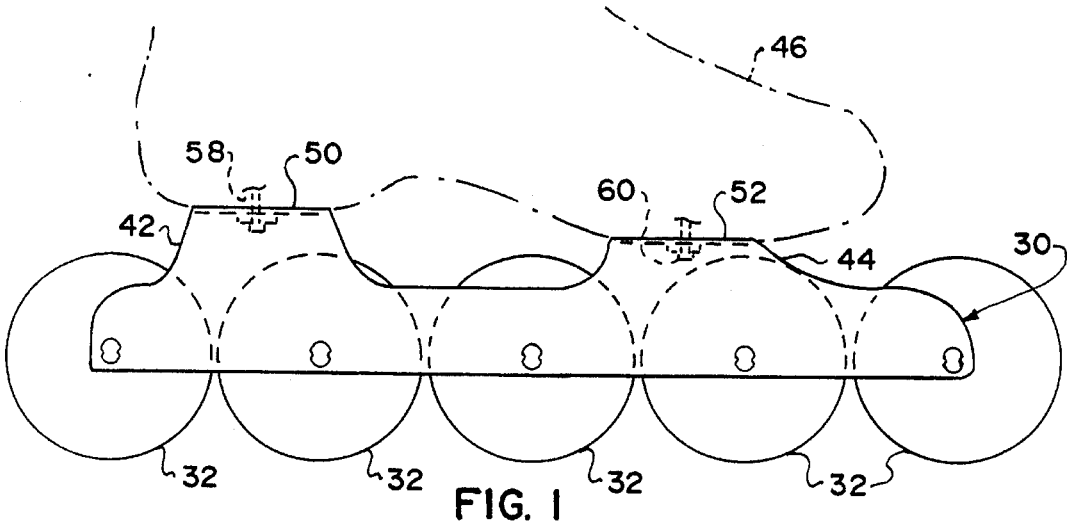
FIG. 1 is a side elevational view of an example of an in-line roller skate frame embodying principles of the invention, including roller wheels mounted on the frame between its side walls.
Figure 2:
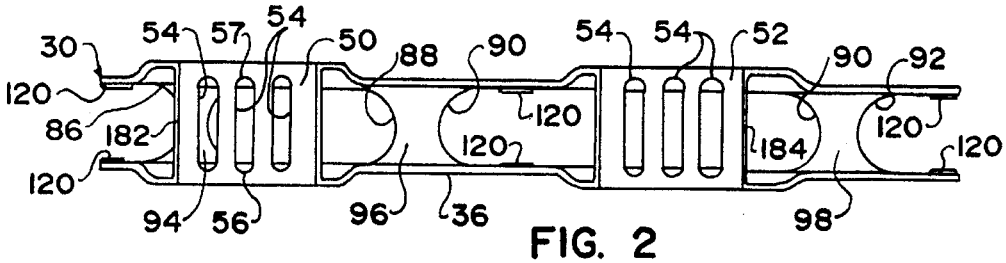
FIG. 2 is a top plan view of the frame of FIG. 1 with the roller wheels being omitted.

FIGS. 1 and 2 disclose an in-line frame 30 on which five roller wheels 32 are mounted. This five-wheel configuration is representative since it is well known that four-, five-, and six-wheel frames are commonplace in in-line roller skates. Frame 30 has been machined from a metal extrusion 34 shown in FIG. 3. Frame 30 comprises parallel side'walls 36, 38 that extend lengthwise of the frame and are spaced apart transversely by a spacing distance 40 shown in FIG. 3.

Frame 30 also comprises two mounting brackets 42, 44 that are spaced apart lengthwise of the frame to provide for mounting of the frame to the heel and sole regions of a skating boot 46 drawn in phantom in FIG. 1. Each mounting bracket bridges side walls 36, 38 and presents to the boot boot-confronting walls 50, 52 respectively. Walls 50, 52 are parallel, having transverse and lengthwise extents on the frame, but are at different elevations of the frame. As can be seen from FIGS. 2 and 3, the transverse extent of each wall 50 is over and outwardly beyond both side walls 36, 38.

Each wall 50, 52 contains a set of three through-slots 54 which extend transversely of the frame. In each set, these through-slots are at uniform spacing distances, and each has a uniform width, except at the ends where they are semi-circularly rounded. The length of each through-slot lies on an axis that is exactly perpendicular to the length of the frame, and is transversely centered in its respective wall 50, 52. The length of each through-slot, as measured between points that are at the mid-points of the semi-circularly rounded ends, 56 and 57 in FIG. 2, spans at least the spacing distance 40 between side walls 38 and 36.

Fastening of frame 30 to boot 46 is accomplished by respective fastening means, 58 and 60 generally, that typically comprise a threaded screw or stud passing through one of the through-slots 54 in each mounting bracket 42, 44. Because of the increased transverse extent of walls 50, 52 and of through-slots 54 that the invention provides when compared with prior frames, the frame of the invention offers significantly increased range for positioning the frame on the boot and increased transverse support of the boot by the frame. These attributes provide for better conformance of the frame to the individual skater without requiring that wider roller wheels also be used. As a consequence, the frame of the invention offers the skater the opportunity for improved skating performance when compared with prior in-line frames.

Figure 3:
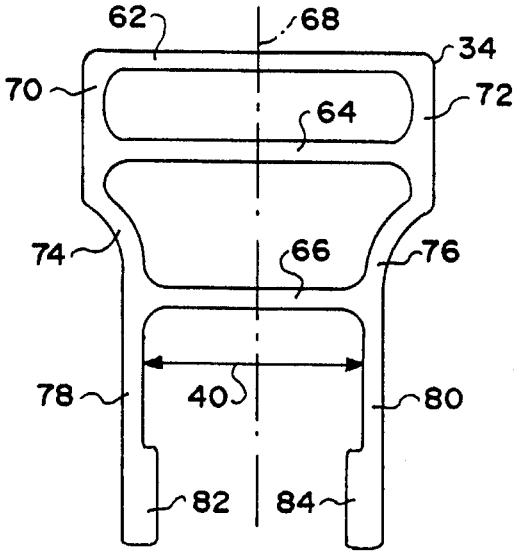
FIG. 3 is an end elevational view of an extrusion from which the frame of FIGS. 1 and 2 was machined, the scale of FIG. 3 being enlarged from that of FIGS. 1 and 2.

From comparison of FIGS. 1 and 2 with FIG. 3, the reader will observe that frame 30 is fabricated from an appropriate length of extrusion 34 by removal of selected portions of the extrusion. Extrusion 34 comprises three horizontal transverse walls 62, 64, 66 from top to bottom in FIG. 3. The extrusion is symmetrical about a vertical bisecting plane 68. Walls 62, 64 have equal widths while wall 66 is narrower. Vertical walls 70, 72 extend between walls 62, 64, and walls 74, 76 that curve inwardly in the downward direction extend between walls 64, 66. Vertical walls 78, 80 extend downwardly from wall 66, and their lower margins are thickened on the inside at 82, 84.

Frame 30 is created by profiling the extrusion to create the profile of FIG. 1. Thus mounting bracket 42 comprises portions of extrusion walls 62, 70, 72, 74, and 76; mounting bracket 44, portions of extrusion walls 64, 74, and 76; and side walls 36, 38, portions of walls 78, 80, respectively. As seen in FIG. 2, certain through-slots 86, 88, 90, and 92 are created in wall 66 to provide clearance for roller wheels 2 while leaving webs 94, 96, 98 to connect the top edges of side walls 36, 38. Side walls 36, 38 are created from extrusion walls 78, 80. The inwardly thickened lower margins 82, 84 are machined to create spaced apart bosses on the insides of side walls 36, 38 in the finished frame, as will be more fully explained hereinafter. And of course, through-slots 54 are machined in frame walls 50, 52.

Figure 6:
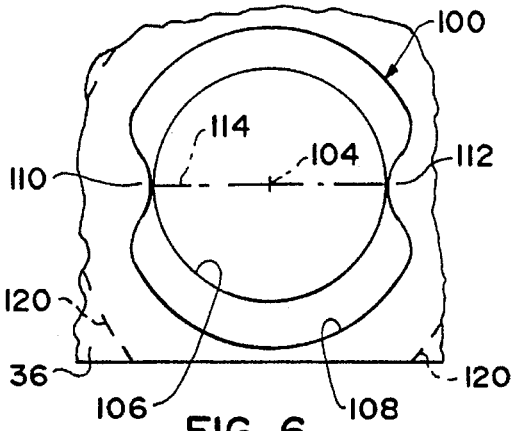
FIG. 6 is a view, on an enlarged scale, in the direction of arrow 6 in FIG. 5.

In order to mount the roller wheels on the frame, a series of through-apertures are provided in side walls 36, 38, there being five such through-apertures for the illustrated five-wheel configuration. Each through-aperture comprises two individual through-apertures, each in a respective one of side walls 36, 38. FIG. 6 shows an individual through-aperture 100 in side wall 36, and FIG. 7 an individual through-aperture 102 in side wall 38. Each of five through-apertures 100 shares a common axis 104 with a corresponding through-aperture 102. In the frame, each axis 104 is horizontal and perpendicular to the two parallel side walls 36, 38.

Through-aperture 100 consists of a circular hole 106 which is proximate the inside surface of side wall 36 and a non-circular hole 108 which is proximate the outside surface of side wall 36. Hole 108 is in the nature of a counterbore since its minimum diametral dimension is at least as great as the diameter of hole 106. Hole 108 comprises a surface that extends around axis 104 and that is circular except for two lobes 110, 112 that are disposed diametrically opposite each other. These lobes project radially inwardly and have crests that lie on a common diameter 114 passing through axis 104 making the two lobes exactly diametrically opposite each other in the preferred embodiment. Diameter 114 is also horizontal, extending along the length of the frame in the in-line direction. It is also seen that the lobes'crests lie on a circle that is just slightly larger than hole 106.

Through-aperture 102 consists of a circular hole 116 proximate the inside surface of side wall 38 and a frusto-conical hole 118 proximate the outside surface of side wall 38. The diameter of hole 116 is equal to that of hole 106. Hole 118 flares outwardly from hole 116.

Figure 7:
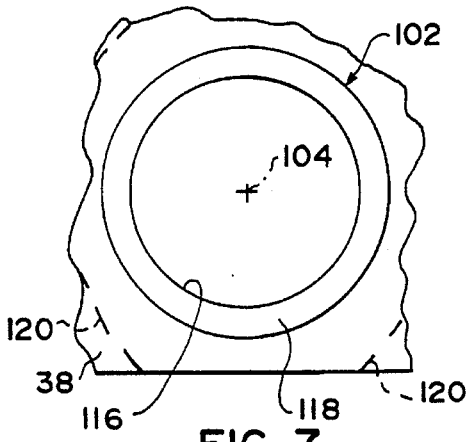
FIG. 7 is a view, on an enlarged scale, in the direction of arrow 7 in FIG. 5.

In both FIGS. 6 and 7, one can see in phantom portions of bosses 120 that surround the through-apertures 100, 102 on the inside surfaces of side walls 36, 38. These bosses have been created from the thickened lower margins 82, 84 of extrusion 34 by selective machining.

Figure 8:
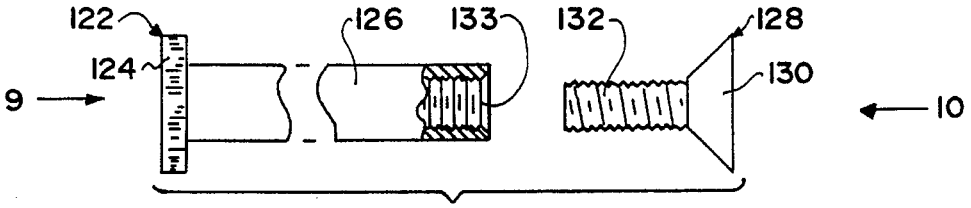
FIG. 8 is a side elevational view, partly in section, of an axle and screw that are used to complete the mounting of FIG. 5.
Figure 9:
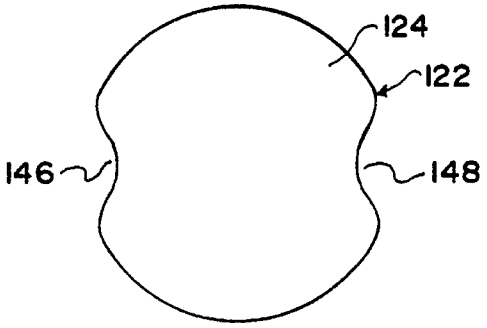
FIG. 9 is an enlarged view in the direction of arrow 9 in FIG. 8.
Figure 10:
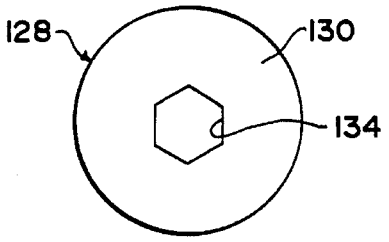
FIG. 10 is an enlarged view in the direction of arrow 10 in FIG. 8.

For mounting each roller wheel on the frame, an axle and screw are required, and they are shown in FIGS. 8–10. An axle 122 comprises a head 124 and a shaft 126 while a screw 128 comprises a head 130 and a threaded shank 132. Axle head 124 has a non-circular shape for its perimeter that matches that of hole 108 for complementary fitting in that hole when the corresponding roller wheel is installed on the frame. Shaft 126 has a circular cylindrical shape whose diameter is just slightly less than that of holes 106 and 116 so that it fits closely therein when installed on the frame. The end of axle 122 opposite its head 124 comprises an internal screw thread 133 providing for reception of shank 132 of screw 128 when installed. Head 130 of screw 128 has a frusto-conical taper matching that of hole 118. It also has a non-circular socket 134 in its end face that is intended to be engaged by a complementary shaped tool for tightening and loosening screw 128 during installation and removal.

Figure 4:
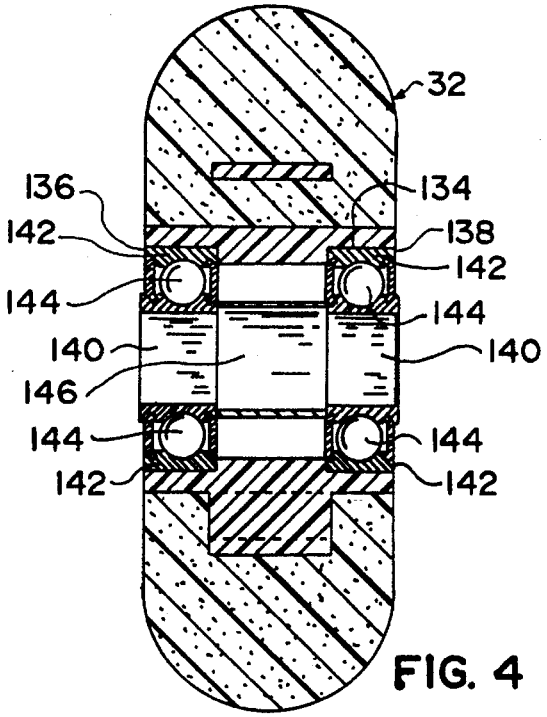
FIG. 4 is a diametral cross sectional view through a representative roller wheel.

FIG. 4 shows a representative roller wheel 32 that may be generally described as comprising through its center a through-hole 134 into opposite ends of which respective bearing assemblies 136, 138 are pressed. Each bearing assembly comprises an inner race member 140 and an outer race member 142 that capture between themselves a number of bearing elements, balls 144 in this instance, to provide low-friction rotation of the outer race member on the inner race member. The inner race members have inside diameters that are just slightly larger than the outside diameter of axle shaft 126 so that the bearing assemblies fit closely on the axle. The inner race members are separated by a tubular spacer 146.

Figure 5:
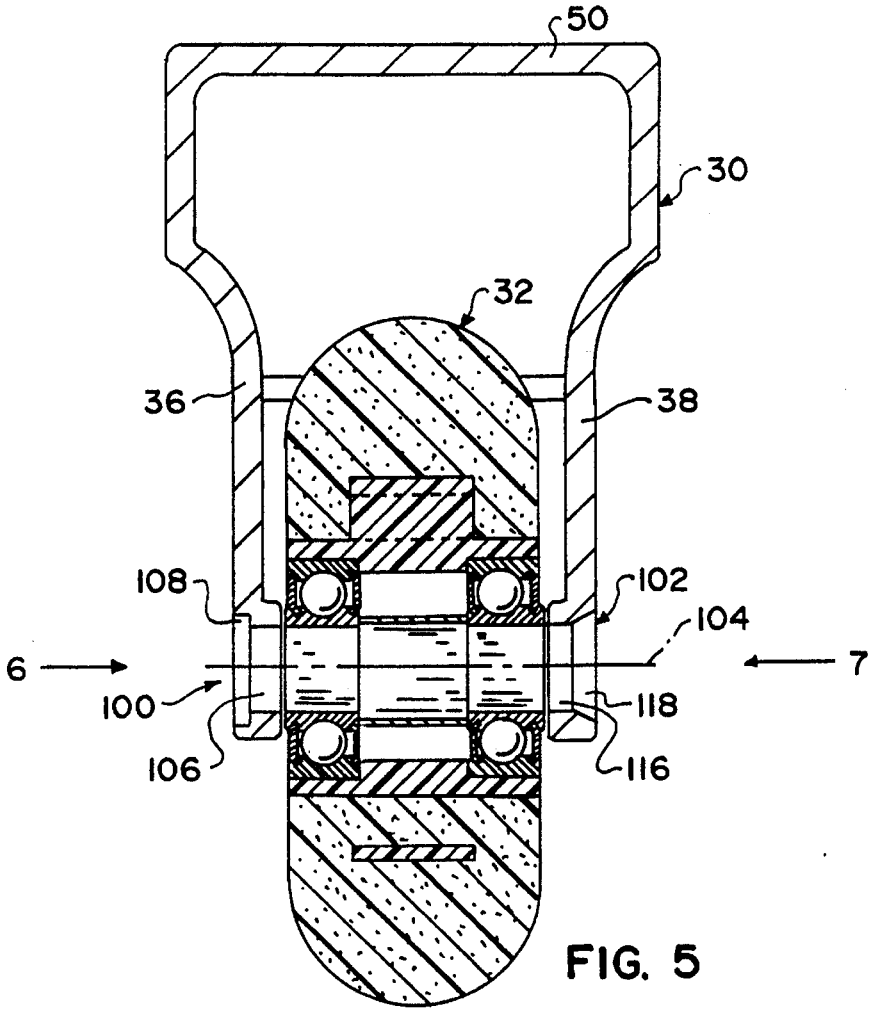
FIG. 5 is a transverse cross sectional view through an incomplete mounting of the wheel of FIG. 4 on the frame of FIGS. 1 and 2.

FIG. 5 illustrates the placement of the roller wheel of FIG. 4 between side walls 36, 38 of frame 30 with its axis coincident with axis 104. This cross section represents the fourth wheel from the right in FIG. 1, i.e. the fourth wheel from the front of the frame. The mounting of the wheel is completed by inserting axle 122 from the left in FIG. 5 and screw 128 from the right. With axle 122 fully inserted, its head 124 fits conformly within hole 108, and its shaft 126 passes closely through hole 106, through the inner race member of bearing assembly 136, through the inner race member of bearing assembly 138, and into hole 116. The shank 132 of screw 128 threads into the internal screw thread 133 in the end of shaft 126 and its head 130 seats in hole 118. Preferably both heads 124 and 130 are flush with the outside surfaces of the two side walls 36, 38 in the completed mounting.

Because the perimeter of axle head 124 is shaped to match hole 108, it has two diametrically opposite lobe complements 148, 150 that fit closely to lobes 110, 112. Each lobe complement, like the corresponding lobe, subtends an acute angle about axis 104. The fit of the axle head 124 to hole 108 constrains the axle from turning when screw 128 is tightened and loosened. A particular advantage is that during tightening, the diametrically opposite lobes distribute the load reaction to the tightening torque to diametrically opposite side of axis 104. As mentioned earlier, this is superior to the interaction of the D-shaped head in the D-shaped hole, and keeps the axle truer to axis 104 than is the case for the D-shaped headed axle.

Figure 11:
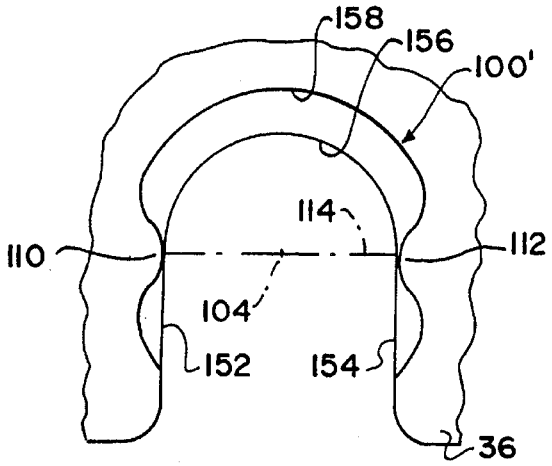
FIG. 11 is a view similar to FIG. 6 illustrating a modified form.
Figure 12:
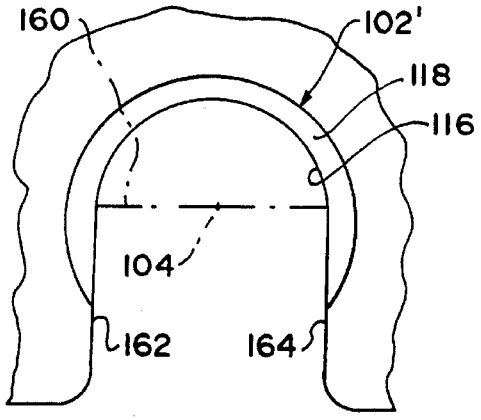
FIG. 12 is a view similar to FIG. 7 illustrating a modified form.
Figure 13:
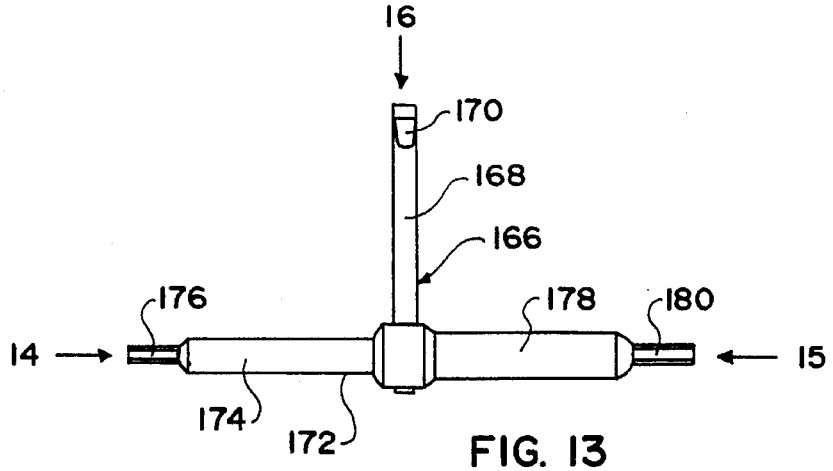
FIG. 13 is a top plan view of a tool that is useful in installing and removing the roller wheels on and from the frame.
Figure 14:
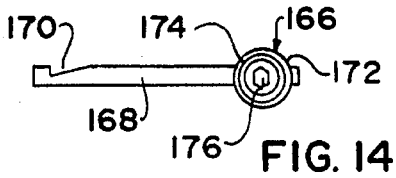
FIGS. 14, 15, and 16 are views in the directions of arrows 14, 15, and 16 respectively in FIG. 13.
Figure 15:
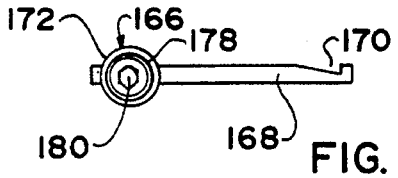
Figure 16:
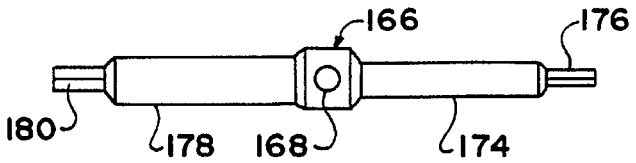
Figure 17:
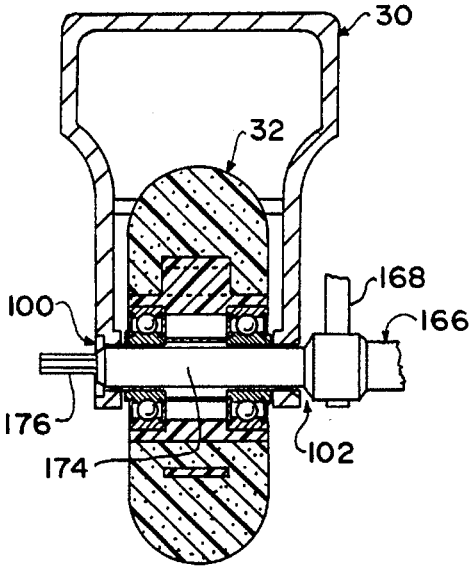
FIGS. 17, 18, 19, and 20 are views illustrating a sequence of steps in mounting a roller wheel on the frame using the tool of FIGS. 13–16.
Figure 18:
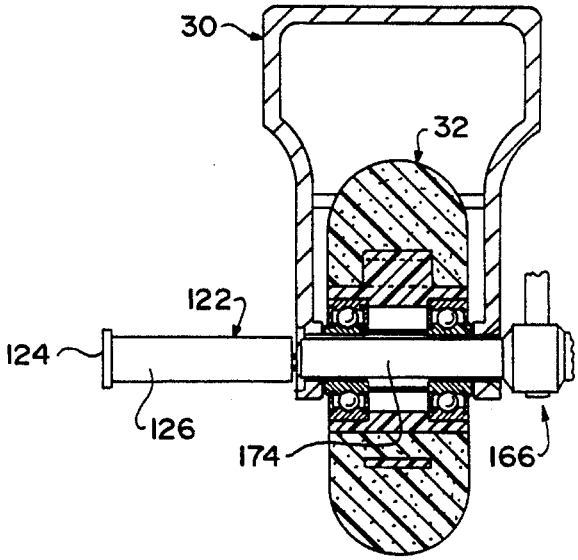
Figure 19:
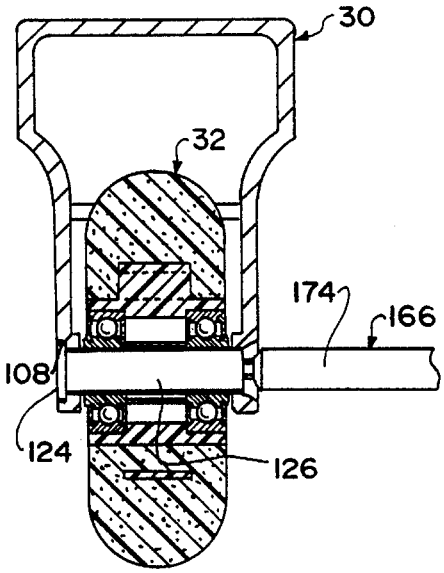
Figure 20:
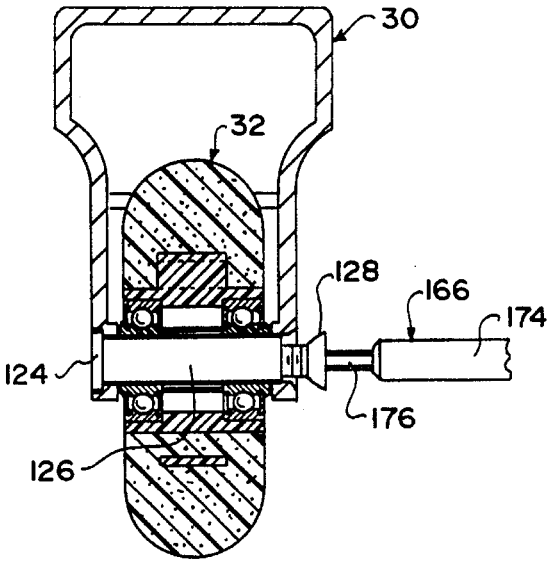

FIG. 11 and 12 illustrate respective modified forms for the two through-apertures 100, 102. These modified forms are designated 100', 102'. Through-aperture 100' is exactly like through-aperture 100 except that material has been removed from the side wall within a zone bounded by diameter 114 and tangent lines 152, 154 extending vertically downwardly from opposite ends of diameter 114 to terminate in outwardly curved leads blending into the lower horizontal edge of the side wall. This arrangement still provides a semi-circular bearing surface 156 corresponding to the upper semi-circular half of hole 106, and it leaves lobes 110, 112 intact, including a circular arc 158 that extends around axis 104 and joins with the lobes. This construction for through-aperture 100' makes it downwardly open to provide for installation of the axle shaft by upward insertion.

Similarly, through-aperture 102' differs from through-aperture 102 by the removal of material from the side wall in a zone bounded by the horizontal diameter line 160 of hole 116 and by tangent lines 162, 164 extending downwardly from opposite ends of the diameter line 160 to terminate in outwardly curved leads blending into the lower horizontal edge of the side wall. In this way, through-aperture 102' is made downwardly open to provide for installation of the axle and screw by upward insertion. With through-apertures 100', 102', the axle and screw may be partially threaded together with the roller wheel on the axle, and this assemblage inserted upwardly into the downwardly open through-apertures. However, axle head 124 must be disposed outside of the outside surface of side wall 36 and screw head 130 must be sufficiently toward the outside of side wall 38 so that it will clear hole 118 during the insertion. Once the assemblage has been sufficiently upwardly inserted to align it with axis 104, the axle may be turned to register its non-circular head with lobes 110, 112 and then pushed into the through-aperture so that its lobe complements 148, 150 fit onto lobes 110, 112. Screw 128 is then tightened to complete the mounting. Removal can be accomplished in opposite fashion. By providing sufficient depth for screw thread 133 and sufficient length for screw shank 132, through-apertures 100', 102' may allow for individual roller wheel mounting and dismounting without separating screw 128 from axle 122.

As an aid to the person aligning frame 30 to boot 46 to obtain the best positioning of the frame on the boot for the individual skater, two alignment markers are provided on the frame to lie on plane 68 and to be visible from the fore and aft directions. These alignment markers are in the form of small notches 182, 184 shown in FIG. 2. Notch 182 is at the middle of the aft-, or rear-facing, horizontal edge of wall 50 while notch 184 is at the middle of the fore-, or front-facing, horizontal edge of wall 52. The typical boot 46 has constructional features defining lateral midpoints of it, and the markers 182, 184 are used to set the frame in relation to such features. This is an advantage because the person performing the adjustment, typically the skater himself, is enabled to more accurately visually determine how best to set the frame on the boot to accommodate his preference.

While a presently preferred embodiment of the invention has been illustrated and described, it should be appreciated that principles are applicable to other embodiments within the scope of the following claims.

What is claimed is:

1. An in-line roller skate frame comprising:

parallel side walls that extend lengthwise of the frame and that are spaced apart transversely in the frame;

through-aperture means in said side walls to provide for the in-line mounting of roller wheels via axles extending between said side walls; and means providing for the mounting of the frame to a skating boot;

characterized in that:

said through-aperture means comprises, for mounting each roller wheel via a corresponding axle, a first through-aperture extending between inside and outside surfaces of one of said side walls and a second through-aperture extending between inside and outside surfaces of the other of said side walls, said first and second through-apertures having a common axis;

said first through-aperture has a semi-circular bearing surface that is proximate said inside surface of said one side wall and a non-circular surface that is proximate said outside surface of said one side wall;

said semi-circular bearing surface serves to bear at least a portion of the load force that is transmitted between the frame and the corresponding axle when the frame is in use;

said non-circular surface extends around said axis generally co-extensively with, but at least radially outward of, said semi-circular bearing surface;

and said non-circular surface has two lobes disposed diametrically opposite each other;

characterized further in that said non-circular surface comprises a circular segment that is centered at said axis and extends circumferentially around said axis and merges into said two lobes;

in that each of the said two lobes subtends an acute angle about said axis, and said and said two lobes lie on a diameter across said axis that is parallel to the length of the frame; and in that each of said lobes projects radially inwardly, and said lobes have respective crests that lie on said diameter.

2. An in-line roller skate frame as set forth in claim 1 characterized further in that said semi-circular bearing surface is one-half of a circular hole forming that portion of said first through-aperture that is proximate said inside surface of said one side wall;

and said two lobes form portions of an otherwise circular hole forming that portion of said first through-aperture that is proximate said outside surface of said one side wall.

3. An in-line roller skate frame as set forth in claim 2 characterized further in that an axle is disposed in said through-aperture means and comprises a circular cylindrical shaft portion that spans the spacing distance between said side walls and fits closely within said circular hole and said second through-aperture;

said axle comprises a head shaped to have a non-circular perimeter that matches and fits closely within said non-circular hole; and said axle is held in said through-aperture means by a headed fastener having a threaded shank that is inserted into said second through-aperture from the outside surface of said other side wall and threads into a complementary thread in said shaft portion of said axle.

4. An in-line roller skate frame as set forth in claim 3 characterized further in that said circular cylindrical shaft portion of said axle is disposed in said second through-aperture.

5. An in-line roller skate frame as set forth in claim 1 characterized further in that said first through-aperture comprises a through-slot that is defined by sides extending from said semi-circular bearing surface to an edge of said one sidewall that extends lengthwise of the frame.

6. An in-line roller skate frame comprising:

parallel side walls that extend lengthwise of the frame and that are spaced apart transversely in the frame;

through-aperture means in said side walls to provide for the in-line mounting of roller wheels via axles extending between said side walls; and means providing for the mounting of the frame to a skating boot;

characterized in that:

said through-aperture means comprises, for mounting each roller wheel via a corresponding axle, a first through-aperture extending between inside and outside surfaces of one of said side walls and a second through-aperture extending between inside and outside surfaces of the other of said side walls, said first and second through-apertures having a common axis;

said first through-aperture has a semi-circular bearing surface that is proximate said inside surface of said one side wall and a non-circular surface that is proximate said outside surface of said one side wall;

said semi-circular bearing surface serves to bear at least a portion of the load force that is transmitted between the frame and the corresponding axle when the frame is in use;

said non-circular surface extends around said axis generally co-extensively with, but at least radially outwardly of, said semi-circular bearing surface;

and said non-circular surface has two lobes disposed diametrically opposite each other; and characterized further in that an axle is disposed in said through-aperture means and comprises a shaft portion that fits in that portion of said first through-aperture that contains said semi-circular bearing surface and in a portion of the second through-aperture;

and said axle further comprises a head portion shaped to have a non-circular perimeter at least a portion of which matches and fits complementary within said non-circular surface, including matching and fitting complimentary to said two lobes.

7. An in-line roller skate frame as set forth in claim 6 characterized further in that said shaft portion of said axle is disposed in said second through-aperture.

* * * * *